US006257469B1

(12) United States Patent
Cohn

(10) Patent No.: US 6,257,469 B1
(45) Date of Patent: Jul. 10, 2001

(54) HOLDER ASSEMBLY

(76) Inventor: David M. Cohn, 2781 Ocean Club Blvd., #304, Hollywood, FL (US) 33019

( * ) Notice: Subject to any disclaimer, the term of this patent is extended or adjusted under 35 U.S.C. 154(b) by 0 days.

(21) Appl. No.: 09/212,590

(22) Filed: Dec. 16, 1998

(51) Int. Cl.[7] ..... A45F 5/00

(52) U.S. Cl. ..... 224/162; 224/269; 224/679; 224/249; 224/196; 206/86; 431/253

(58) Field of Search ..... 224/163, 666, 224/269, 679, 249, 196, 162, 251; 206/815, 86, 87, 804, 349, 234; 431/253, 343; 24/3.13, 3.7

(56) References Cited

U.S. PATENT DOCUMENTS

| | | | | |
|---|---|---|---|---|
| D. 267,597 | | 1/1983 | Carter . | |
| 1,262,005 | * | 4/1918 | Bell | 224/162 |
| 1,675,072 | * | 6/1928 | Watermon | 224/162 |
| 4,135,267 | | 1/1979 | McKinney, Sr. et al. . | |
| 4,252,237 | * | 2/1981 | Ballit | 206/86 |
| 4,363,432 | | 12/1982 | Warthen . | |
| 4,486,169 | * | 12/1984 | Lewis | 431/253 |
| 4,790,461 | | 12/1988 | Stover . | |
| 4,923,105 | | 5/1990 | Snyder . | |
| 4,923,392 | * | 5/1990 | Moynihan, III | 431/253 |
| 4,927,354 | | 5/1990 | Sanford . | |
| 4,986,459 | * | 1/1991 | Yarbrough, Jr. . | |
| 5,531,368 | | 7/1996 | Morford . | |
| 5,683,022 | | 11/1997 | Evans . | |

* cited by examiner

*Primary Examiner*—Nathan J. Newhouse
(74) *Attorney, Agent, or Firm*—Malloy & Malloy, P.A.

(57) ABSTRACT

A holder assembly which may be removably mounted on the person of a user and which is designed for holding a cigarette lighter and a bottle opener for convenient and repeated use by bartenders in order to properly service their customers, wherein the holder assembly includes a base having a pocket structure formed on a front surface thereof which is specifically dimensioned and configured to correspond to the cigarette lighter. A compartment is disposed in said base and is dimensioned and configured to contain a retraction structure which is operatively connected to the bottle opener and includes a spring biased take-up reel from which a flexible, cord extends and is secured to the bottle opener, thereby facilitating the outwardly extended yet retractable positioning of the bottle opener for use while maintaining secure attachment thereof to the user. The holder assembly may also include an illumination assembly capable of being selectively activated by a hand operated switch for illuminating darkened areas or otherwise serving customers.

27 Claims, 3 Drawing Sheets

HOLDER ASSEMBLY

BACKGROUND OF THE INVENTION

1. Field of the Invention

This invention relates to a holder assembly specifically designed to hold common utensils or like devices such as a disposable lighter, bottle cap opener, etc. of the type used repeatedly by bartenders or other personnel wherein such devices are disposed in a readily accessible location to facilitate the repeated access and use of such utilitarian devices.

2. Description of the Related Art

Tool belts, instrument holders and like structures are, of course, well-known and exist in the prior art in a number of different structural embodiments comprising a variety of a configurations, dimensions, etc. Typically, the design and structuring of such tool belts or like holder assemblies are dependent upon the tools, instruments, utensils or devices intended to be mounted therein. Such tools or accompanying devices in turn are dependent upon the activities a user of such tools intends to perform. Tool belts and tool holders specifically designed for a plurality of specific professions or jobs are perhaps best known and are designed to removably contain construction tools, electrician's tools, plummer's tools, etc. A typical structural configuration of such tool holder includes an elongated belt generally formed of a flexible material and designed to be connected in surrounding relation to a worker's waist. The disposition and configuration of a holder structure connected to such belts enable a wide variety of tools or like devices to be carried thereon.

One profession which appears not to have the consistent availability of any type tool belt or tool holder assembly is that of a bartender. It is, of course, well recognized that bartenders, while performing their duties, which include servicing a plurality of customers, utilize a large variety and number of utensils or like devices. Typically, such utensils are intended to aid the bartending personnel in the preparation of beverages and/or accompanying garnish items such as fruits, vegetables or the like which are frequently added to beverages for purposes of flavoring or decoration. The variety of utensils typically utilized by a bartender include but of course are not limited to knifes, forks, spoons, stirring devices, straws, etc. These tools or utensils are normally positioned at some mutually agreed upon, strategic location about the servicing and preparation area of the bar in order that such utensils may be used by a plurality of different personnel concurrently working in the same general area. The above mentioned utensils are generally utilized in the same common area depending upon whether such utensils are being used for preparation, serving, etc. Since most of the beverages in a bar or lounge atmosphere are generally prepared in a common preparation area and subsequently transported to the customer for serving, a convenient location for such utensils in the vicinity of their intended area of use is a more practical alternative then requiring each of the bartending personnel to carry such utensils on there person.

However, the frequent use and required accessibility of certain devices or utensils, other than those of the type set forth above, do in fact require that bartender personnel have immediate access to such devices in order that one or more customers may be immediately and repeatedly serviced in an efficient manner. Such quick and efficient service has now come to be expected by a large number of the consuming public which frequent lounge or bar establishments. More specifically, such utensils include but are not necessarily limited to cigarette lighters and/or bottle openers.

In recent years disposable cigarette lighters have been used extensively. Such disposable lighters are generally small, lightweight and may be easily carried and operatively manipulated by a single hand of a user. Once the fuel within the disposable lighter structure has been depleted the entire lighter structure is discarded. While such disposable lighters were initially designed for efficient, convenient use and carrying on the person of the user, such as in one's pocket, purse, etc., the size and configuration of the typical disposable lighter makes its readily adaptable for carrying in a preferred holder assembly which may be removably attached to the person, such as on the clothing, of a user of the cigarette lighter. While not officially mandated, it is extremely common for bartender personnel to expedite service and comfort of a plurality of customers by lighting their cigarettes. Accordingly, the positioning and carrying of such cigarette lighters should be such as to facilitate ready access and frequent utilization. Furthermore, the carrying of a cigarette lighter within a pocket of the bartender can often be quite inconvenient, as the bartender may have other items in their pocket which obstruct or hinder removal. In addition, bartenders often have wet hands making it undesirable to insert their hands into a pocket to retrieve the lighter.

Other tools which may best be used when carried on the person of bartending personnel may include a utensil used to remove the metal caps from beverage containing bottles. It is, of course, recognized that a large majority of beverage containing bottles are currently supplied with "twist off" caps. The structuring of such caps or like closure devices are such as to allow the removal of the cap structure by a person exerting a twisting force on the cap with one hand while holding the bottle firmly with the other. While the force required to remove such caps is minimal, care must be taken in order to prevent a person's hand becoming cut, scratched or otherwise damaged. However, in the normal performance of a bartender's duties, an extremely large number of such caps must be repeatedly removed since the main function of a bartender is to serve beverages frequently contained within bottles or like containers having such twist off caps. It is generally accepted among bartending personnel that continuous and repeated removal of this type of cap or closure structure does in fact result in painful damage to the person's hands because of the frequency with which such caps are removed. Therefore, it is common practice for bartenders to utilize utensils specifically designed for the removable of such caps without the user of such utensils having direct contact or engagement with the cap itself. Of course, it is noted that a variety of beverages still utilize non-twist off caps which require the use of a bottle opener.

Much like with the cigarette lighter, it is inconvenient to maintain a bottle opener disposed in a pocket if repeated uses are expected. In addition to the above reasons relating to clutter in the pocket and or wet hands, the bottle opener itself is often wet and may often contain a sharp point, further contributing to the undesirable nature of storing a bottle opener in a pocket. Furthermore, unlike the less expensive, disposable cigarette lighters, bottle openers are often more expensive and a bartender is expected to keep a single bottle opener for an extended period of time. As a result, it would be beneficial to provide a structure that ensures that a bottle opener is not lost, even after repeated uses in a crowded environment, and even if others borrow or also use the bottle opener.

Based on the above, there is a need in the bartending industry for a holder assembly designed specifically to removably contain and support one or more utilitarian devices such as a cigarette lighter, bottle cap opener or like utensil, wherein such a preferred holder assembly may be mounted on the person, such as on the clothing of a bartender or user of such utensils. Such a preferred holder assembly should also be capable of providing free and easy access to such utensils such that frequent and repeated use thereof is facilitated, and should maintain the bottle opener secure and generally free from easy loss or misplacement.

SUMMARY OF THE INVENTION

The present invention is directed towards a holder assembly designed to removably support and dispose one or more utilitarian devices in a location, preferably on the person of a user of such devices, in a convenient and accessible location thereby facilitating repeated use of such devices. The holder assembly of the present invention, in one preferred embodiment, is designed to removably hold utensils which may be specifically adapted for use during the performance of duties associated with bartending. Accordingly, a preferred embodiment of the holder assembly of the present invention is designed to removably support a disposable lighter and/or a bottle cap opener. It should be noted that the holder assembly of the present invention could easily be designed in terms of altering certain dimensions and configurations thereof so as to be readily adapted for the support of a variety of utensils, other than those set forth hereinafter, and still be considered to fall within the intended spirit and scope of the present invention.

More specifically, the holder assembly of the present invention includes a base which in one embodiment may preferably be formed of an integral, one piece construction, from a material which is either rigid, semi-rigid or at least minimally flexible, such as but not limited to, a single molded plastic piece. Further, the base of the holder assembly has a pocket structure formed preferably on an exposed, front surface thereof, wherein the pocket structure includes a hollow interior portion dimensioned and configured to removably contain and support an elongated utensil such as a disposable cigarette lighter therein. The structure and overall configuration of the pocket structure is such as to restrict inadvertent removal or displacement of the lighter from the hollow interior of the pocket structure while rendering the disposable cigarette lighter readily accessible and facilitate removal thereof from the interior of the pocket structure by means of a single hand of a user or wearer of the holder assembly. To this end, the pocket structure includes a first opening preferably defined by an open end thereof and dimensioned and configured to allow passage of the cigarette lighter or other applicable utensil therethrough. Insertion and removal of the lighter from the pocket structure is thereby also facilitated.

The pocket structure also includes a second opening disposed preferably in spaced relation to the first opening and extending along a longitudinal dimension of the pocket structure. The second opening is disposed, configured and dimensioned to allow digital contact of at least one finger of the user with the lighter when contained within the pocket structure. Such direct engagement by the finger of the user will facilitate a lifting force being exerted on the lighter. The lifting force will be exerted on the lighter in a manner which will accomplish quick and easy displacement of the lighter from the hollow interior of the pocket structure through the aforementioned first opening. The user of the device will therefore be able to frequently and repeatedly use the lighter as intended for the efficient servicing of a plurality of customers.

The base of the holder assembly also preferably includes a compartment. This compartment, which may be formed on a rear surface of the base in spaced, substantially opposing relation to the pocket structure is preferably structured to contain and retain a retraction structure. One preferred embodiment of the retraction structure comprises a spring biased take-up spool mounted within the interior of the compartment and being connected to an elongated cord such that a spring biased tension is continuously applied to the cord tending to normally cause a retraction of the cord into the compartment and into a wound about, stored position on the take-up spool. The compartment includes an open face which may be covered by a closure in the form of a cap or like cover structure in order to segregate the interior of the compartment as well as the take-up spool and cord therein from the exterior of the compartment. In another embodiment of the present invention the retraction assembly includes an independent spring loaded casing fixedly or removably mounted within the compartment, and structured to house or otherwise contain the retraction structure. In either of the above noted embodiments, the retraction structure includes the elongated cord or cable wound about the take-up spool or the like. The take-up spool, is spring biased so as to be normally biased in a cord retracting mode, thereby placing a substantially constant tension on the cord while the attached bottle opener is extended outwardly from the compartment or casing. A distal or free end of the cord is secured to the bottle opener which may be selectively extended outwardly from the compartment or spring biased casing by exerting a pulling force thereon. With either of the above noted embodiments the bottle opener is normally disposed exteriorly of the base of the holder assembly in a depending position therefrom. By virtue of this disposition the bottle opener or like utensil is normally disposed in a readily accessible location to facilitate the gripping of the utensil by a single hand of the user and the exertion of sufficient pulling force on the spring biased cord to position the utensil in an operative position relative to a bottle being opened. Release of the bottle cap opener, by the hand of the user, will result in an automatic rewinding of the cord due to the tension or biasing force exerted thereon and a retraction of the bottle opener into its normally depending, readily accessible position.

Other structural features of the present invention may include an illumination assembly mounted on the base and selectively operable by a hand manipulated switch. This illumination assembly may be used when necessary to project light onto darkened areas or as otherwise needed.

Therefore, it is a primary object of the present invention to provide a holder assembly designed to removably support and dispose one or more utensils for convenient access and repeated use.

An important object of the present invention is to provide a holder assembly which effectively and accessibly disposes and retains a cigarette lighter for repeated use.

A further object of the present invention is to provide a holder assembly which effectively secures and retains a bottle opener, while also disposing the bottle opener in a conveniently usable position.

Another primary object to the present invention is to provide a holder assembly which serves to removably support and mount the preferred or pre-determined utensils in a convenient location, preferably but not necessarily on the person of the user.

Yet another important object of the present invention is to provide a holder assembly specifically designed to removably support and dispose utensils commonly used in the servicing of customers by bartender personnel.

Still another important object of the present invention is the providing of a holder assembly for one or more utensils which is formed of lightweight yet durable material, preferably, but not necessarily of one piece construction and which may be positioned or mounted in a variety of locations which may include being attached to the clothing of a user of the device.

It is also an important object to the present invention to provide a holder assembly which securely but removably retains one or more utensils in a convenient, readily accessible location and which is structured to restrict inadvertent displacement, loss or removal of such utensils from the holder assembly.

Yet another important object of the present invention is to provide a holder assembly which may incorporate an illumination assembly for the selective illumination of darkened areas or for a variety of other uses common to bartender personnel when performing their normal duties or servicing customers.

These an other objects, features advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
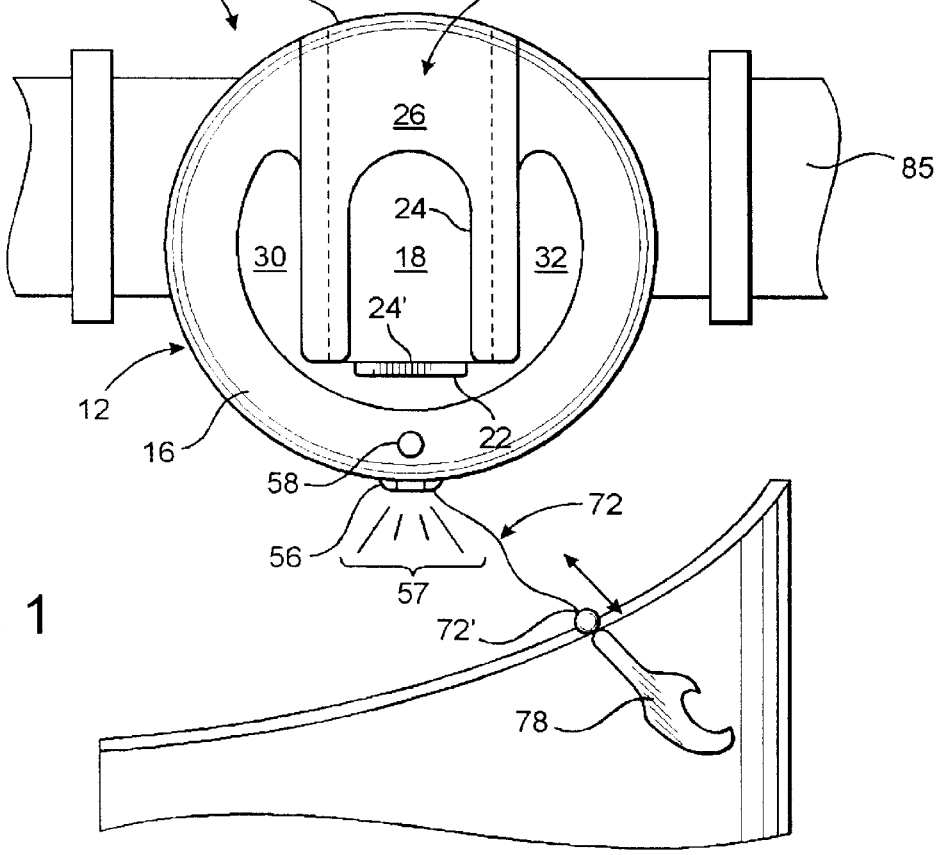
FIG. 1 is a perspective view of a holder assembly of the present invention mounted on the person of a user.

In accordance with the accompanying Figures, the present invention is directed towards a holder assembly, generally indicated as 10, and preferably structured for use by a bartender or like serving personnel. The holder assembly 10 comprises a base 12, which may be formed of a molded plastic or other preferably lightweight, durable material and which also may include at least a minimal amount of flexibility to accommodate the support and repeated removal of one or more utensils or like utilitarian devices. If formed of a molded, plastic material, the base 12 may be of a unitary, one piece construction. Alternately, the holder assembly 10, specifically including the base 12, may be formed of other materials or in multiple pieces, wherein the various components, to be described in greater detail hereinafter, may be fixedly secured to one another or contained by the base 12 in an appropriate manner so as to removably support and dispose one or more of the aforementioned utensils for convenient access and repeated use. In addition, at least one embodiment of the present invention may include the base having an at least partially hollow configuration to enclose one or more batteries or the like. The batteries may be used to power a light bulb 56 as will be explained in greater detail with reference to the embodiment of FIGS. 1 and 8.

More specifically, a pocket structure 14 is preferably defined at the front surface 16 of the base 12 so as be readily accessible when the base 12 is mounted or carried on the person of a user of the subject holder assembly 10. The pocket structure 14 includes a hollow interior as at 18 preferably having a somewhat elongated configuration terminating in an open end which defines a first opening 20. In particular, the overall configuration of the pocket structure 14 and the dimension and configuration of the hollow interior 18 thereof is specifically adapted so as to at least partially correspond to a specific utensil such as and preferably a disposable, portable cigarette lighter of the type commercially available and wellknown in the art. It is of course noted that the disposition, configuration and dimension of the pocket structure 14 could vary to the extent of corresponding to other specific utensils or cigarette lighter shapes or configurations commonly used by a variety of personnel. However, in the preferred embodiment of the present invention the utensil intended to be carried includes the conventionally designed, portable, disposable cigarette lighter which is used repeatedly and extensively by bartending personnel.

The pocket structure 14 is further defined by a stop portion 22 disposed generally opposite to first opening 20 of the pocket structure 14. The stop portion 22 extends outwardly from the base 12 so as to at least partially cover the opposite end of the hollow interior 18 relative to the first opening 20 and so as to engage and support the bottom of the cigarette lighter causing it to be oriented in a somewhat upright, vertical orientation. This upright orientation of the cigarette lighter is further facilitated by not only the placement of the stop portion 22 but its disposition and configuration relative to the remainder of the hollow interior 18.

Further defined in the pocket structure 14 of the preferred embodiment is a second opening as at 24. The second opening 24 also has somewhat of an elongated configuration and extends at least partially along the length of the pocket structure 14 and especially along a length of the hollow interior 18 defined by the pocket structure 14. In the preferred embodiment of the present invention, the second opening 24 also extends substantially into accessing relation with the hollow interior 18 of the pocket structure substantially along the length of the pocket structure 14. In a most preferred embodiment, however, the second opening 24 may also extend into the stop portion 22, at least partially defining the stop portion 22 opposite the first opening 20. This extended portion of the second opening as at 24' is specifically disposed and dimensioned so as to allow a lifting force to be placed on the bottom of the utensil or cigarette lighter intended to be removably supported within the pocket structure 14, thereby greatly facilitating rapid removal of the lighter. It should also be apparent therefore, that the placement, configuration and dimension of the second opening 24, including the end portion 24' thereof, is specifically intended to facilitate digital contact or engagement with the lighter contained within the hollow interior 18 of the pocket structure 14. This in turn will facilitate an easy, generally frictional removal or displacement of the cigarette lighter up and out through the first opening 20.

Repositioning or mounting of the utensil or cigarette lighter back into the hollow interior 18 is also further facilitated in that the first opening 20 and the second opening 24 are cooperatively disposed, configured and dimensioned to facilitate repeated and frequent insertion and removal of a utensil, such as the cigarette lighter, relative to the hollow interior 18 of the pocket structure 14.

Figure 2:
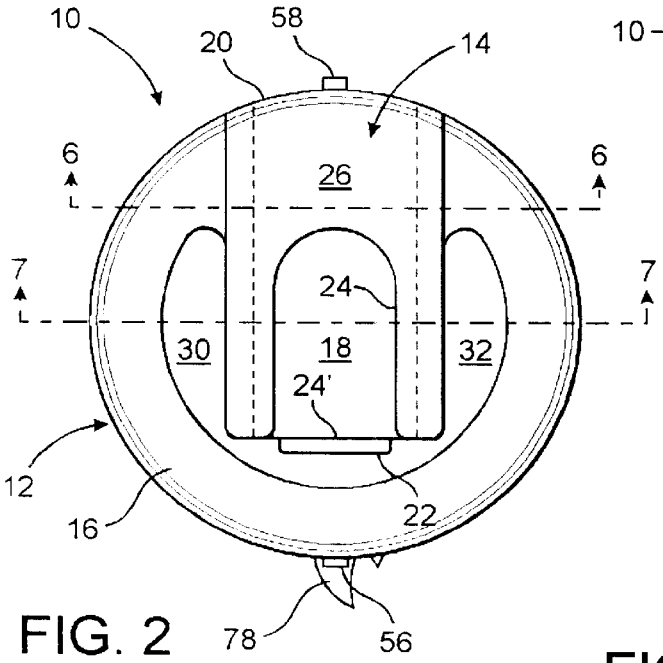
FIG. 2 is an isolated frontal view of an embodiment of the holder assembly of the present invention.
Figure 3:
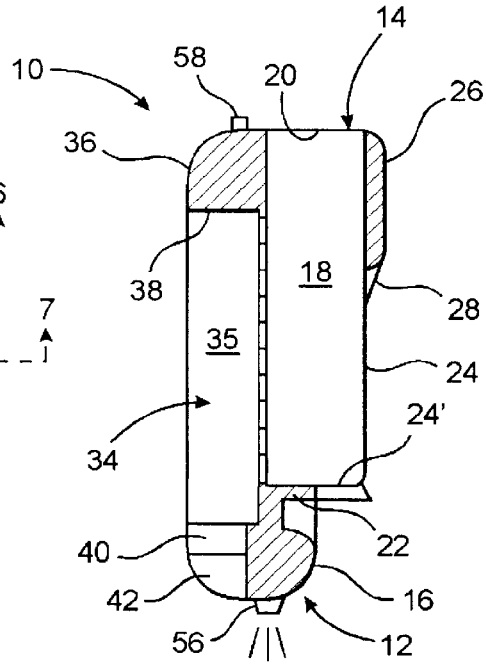
FIG. 3 is a side, sectional view of the embodiment of FIG. 2.

With regard to FIGS. 2 and 3, the pocket structure 14 also includes a solid wall portion 26 serving to separate or somewhat segregate the first opening 20 from the second opening 24 and more importantly to define the overall longitudinal dimension of the pocket structure 14. To further facilitate a lifting or displacing force being placed on a utensil within the hollow interior 18, a transitional zone 28 is preferably integrally formed on a peripheral portion of the solid wall portion 26. Such a transitional zone 28 has a somewhat tapered configuration to facilitate engagement of a user's finger with the utensil or cigarette lighter as it passes out through the first opening 20. The finger is therefore maintained in generally continuous engagement with the utensil within the hollow interior 18 for somewhat of an extended period as the displacing force is maintained on the utensil by the finger as it passes out through the first opening 20. Also, when the finger temporarily disengages the lighter because of a termination of the second opening 24, the transitional zone 28 helps to smoothly and effectively guide continued movement of the finger until it re-engages the lighter exiting the first opening 20. Although this is the preferred configuration, it should be noted that the second opening may extend into the first opening 20, with the wall portion 26 extending along a length of the pocket structure 14 only to the extent of retaining the lighter within the pocket structure 14 and further defining the hollow interior 18.

Figure 7:
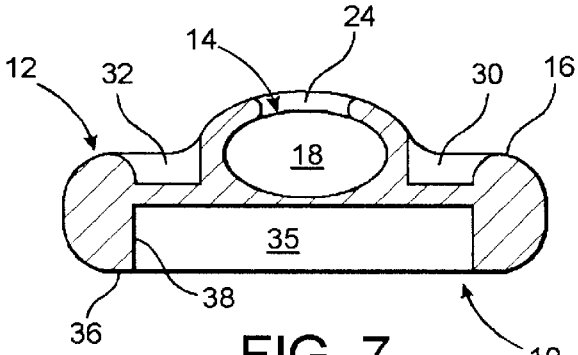
FIG. 7 is a transverse sectional view along line 7—7 of FIG. 2.

In order to further facilitate digital engagement and resulting displacement of the first utensil or device from the hollow interior 18 of the pocket structure 14, the present invention further includes at least one but preferably two spaced apart recesses 30 and 32 integrally formed in the front surface 16 of the base 12, as best shown in FIGS. 1, 2 and 7. The recesses 30 and 32 have a somewhat elongated configuration so as to extend substantially along at least a portion of the length of the second opening 24 and the pocket structure 14. Further, each of the recesses 30 and 32 are disposed on an opposite side of the first opening 20 in spaced apart but immediately adjacent relation to both the second opening 24 and the pocket structure 14. By virtue of the presence of the recesses 30 and 32, a user of the holder assembly 10 is permitted to have spaced apart fingers of a single hand, slide along the length of the recesses 30 and 32 while a central finger of the same hand engages and maintains a displacing force on the cigarette lighter or first utensil or device within the hollow interior 18 of the pocket structure 14 as it is lifted upwardly out through the first opening 20 of the pocket structure 14. The single hand of the user is therefore merely slid along the outer or front surface 16 of the base 12 as the spaced apart fingers are maintained in sliding engagement with the respective recesses 30 and 32 and another finger of the same hand engages and places an upwardly directed, displacing force on the cigarette lighter or other first device or utensil within the pocket structure 14.

The preferred embodiment of the holder assembly 10 of the present invention further includes a retraction structure. The retraction structure is operatively coupled to a second utensil, such as a bottle cap opener commonly of the type used by bartending personnel. Furthermore, the retraction structure is configured to retractably extend the bottle opener into operative engagement with a bottle while the holder assembly 10 is maintained on the person of the user.

Figure 4:
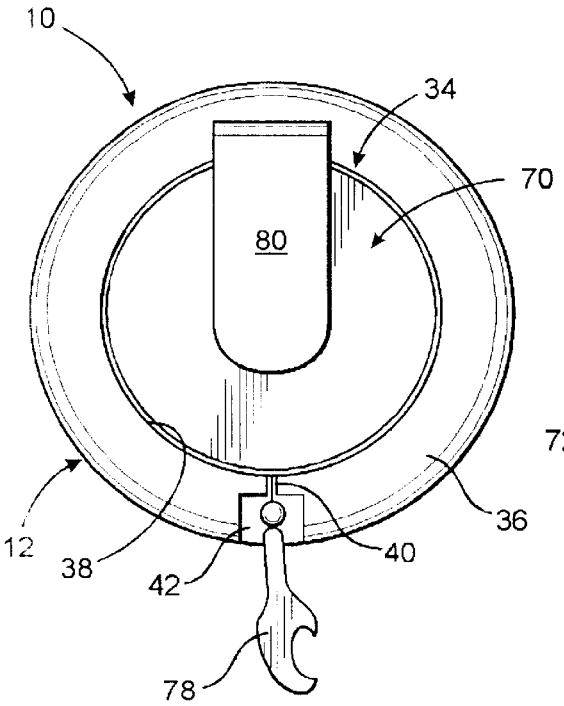
FIG. 4 is a rear view of the embodiment of FIGS. 2 and 3.
Figure 5:
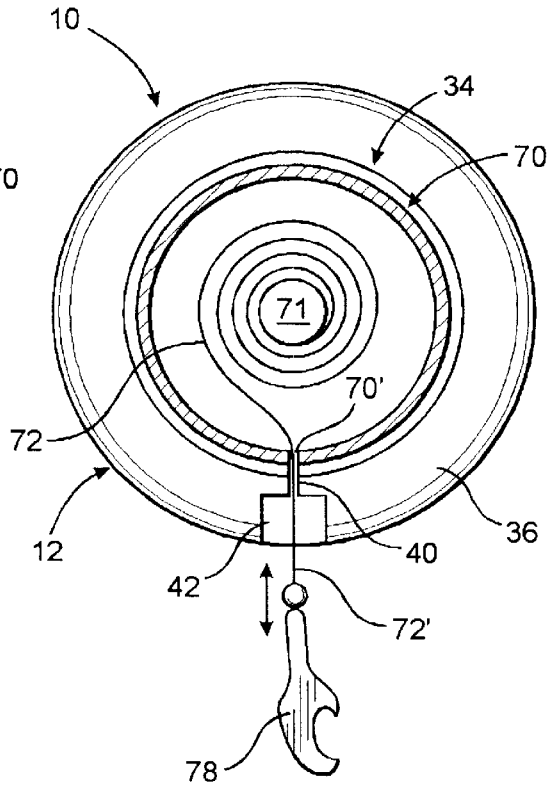
FIG. 5 is a rear sectional view of the embodiment of FIGS. 2 and 3.
Figure 6:
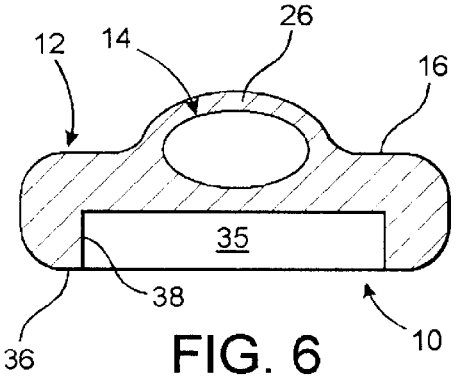
FIG. 6 is a transverse sectional view along line 6—6 of FIG. 2.

In the preferred embodiment of FIGS. 4 and 5, the retraction structure preferably comprises a spring loaded casing 70. The spring loaded casing 70 preferably includes a spring loaded, take up reel 71 or the like, designed to have an elongated flexible cord 72 wound thereabout. As such, the cord 72 can be effectively extended from the spring loaded casing 70 by countering the biasing force of the take up reel 71 and thereby extending an article connected to the cord 72 a distance from the spring loaded casing 70 and the base 12 on which it is mounted. Although it is possible for the bottle opener to be integrated into the base 12, with a free end of the cord being connected to a clip or like structure that secures the holder assembly 10 to the user so that the entire base 12 can be extended from the person of the user, in a preferred embodiment, the free end 72' of the cord 72 is preferably connected to the second utensil, namely the bottle opener, so as to permit the bottle opener to be easily separated from the base 12 for use without risk of it being lost.

The spring loaded casing 70 is preferably contained by the base 12 and in the illustrated embodiment of FIGS. 4 and 5 a compartment 34 has an interior portion 35 and is formed in the rear surface 36 of the base 12. As illustrated, the compartment 34 has an at least partially open face to facilitate the insertion and removal of at least a portion of the spring loaded casing. Furthermore, the compartment 34 has a surrounding retaining wall 38 disposed in somewhat surrounding relation to the interior portion 35 of the compartment 34 and being disposed, dimensioned and configured to somewhat correspond, along with the remaining surfaces of the interior portion 35, to the spring loaded casing 70 so as to facilitate retention thereof within the compartment 34. Of course the spring loaded casing 70 and the compartment may include a variety of mating shapes, and/or additional structure may be provided so as to retain the spring loaded casing 70 within the compartment 34.

Figure 9:
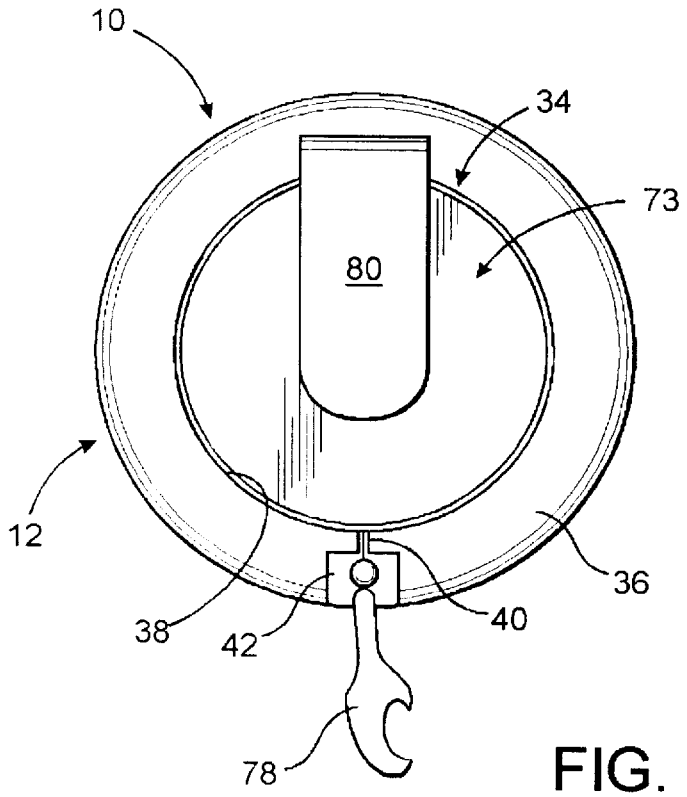
FIG. 9 is a rear view of another preferred embodiment of the present invention.
Figure 10:
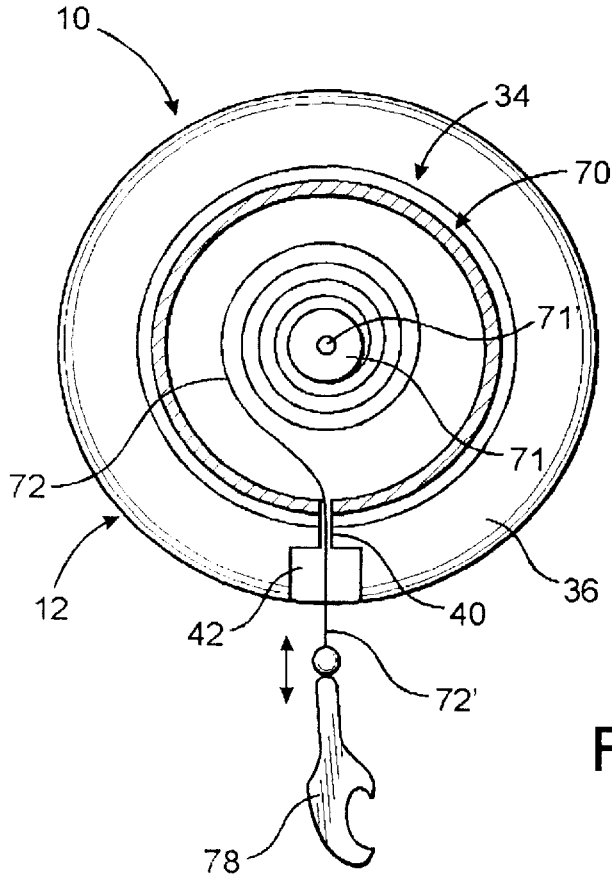
FIG. 10 is a rear, partially interior view of the embodiment of FIG. 9.

Another preferred embodiment of the present invention is best shown in FIGS. 9 and 10, wherein the retraction structure is mounted or otherwise secured directly within the interior 35 of the compartment 34 and is absent any type of independent spring biased casing. More specifically, the retraction of structure of the preferred embodiment of FIG. 10 includes a spring biased, rotatable spool 71 which may be rotationally mounted or otherwise rotationally supported within the interior 35 of the compartment 34 by means of a spindle 71' integrally secured or otherwise fixedly attached to the interior 35 of the compartment 34. The elongated cord 72 has one end or other portion thereof secured to the spring biased spool 71 and its opposite or free end connected directly to the bottle opener 78 as at 72'. Accordingly, in the embodiment of FIGS. 9 and 10 the compartment 34 may have somewhat of a smaller configuration, in that the peripheral retaining wall 38 only has to enclose or operatively contain the spring biased spool 71 and the elongated cord 72 attached thereto within the interior 35. As best shown in FIG. 9 a closure, preferably in the form of a cap or cover plate 73 may be removably attached in closing relation to the open face of the compartment 34 and in overlying, covering relation to the take-up reel 71 as well as the cord 72 contained within the interior 35. The closure or cover plate 73 may be secured in its covering relation to the interior 35 by any of a variety of fastening structures including a threaded attachment, snap-fit construction or the like. Of course, a more integral construction wherein the base 12 itself includes two or more mating components to house the retracted cord 72 may also be provided.

Another structural feature of the compartment 34 includes a passage 40 disposed in direct, communicating relation between the interior portion 35 of the compartment 34 and an exterior opening 42. The passage 40, and to a certain extent the exterior opening 42, are provided so as to allow passage of the aforementioned cord 72 into and out of its wound relation about the take up reel 71. When utilizing the spring biased casing 70 of the embodiment of FIGS. 4 and 5, the passage 40 as well as the exterior opening 42 are aligned with an opening 701 formed in the surrounding wall of the spring biased casing 70 in order to allow the passage of the cord 72 therethrough and outwardly from the base 12 and into its intended attached position with the bottle opener 78. When utilizing the embodiment of FIGS. 9 and 10, the cord 72 passes directly through passage 40 and opening 42 since this embodiment does not include the aforementioned spring bias casing 70 as disclosed with regards to the embodiment of FIGS. 4 and 5.

In either embodiment, a sufficient amount of the cord 72 extends outwardly from the base 12 to accomplish attachment of the bottle opener 78 to the free end of cord 72 and preferably as to permit the bottler opener to depend downwardly from the exterior of the base 12. This depending, downwardly extending position of the bottle opener 78 provides convenient access to a user of the subject holder assembly 10, wherein the bottle opener 78 is readily accessible for frequent use.

Other features of the present invention may include a mount assembly structured to secure the holder assembly 10 to a user. In the preferred embodiment, the mount assembly includes a spring biased clip as at 80 secured to the base 12 in an appropriate location, such as adjacent to or in somewhat overlying relation to the rear surface 36. Further, the spring biased clip 80 is specifically configured to facilitate removable attachment of the holder assembly 10 to the clothing, such as a belt 85, or other portion of the person of the user, wherein the holder assembly 10 may be disposed in a convenient location. Additionally, depending upon the overall dimension and configuration, as well as the placement of the spring biased clip 80, it may somewhat overlie the exposed open face of the compartment 34 so as to prevent inadvertent removal or displacement of the aforementioned spring loaded casing from the interior 35 of the compartment 34.

Figure 8:
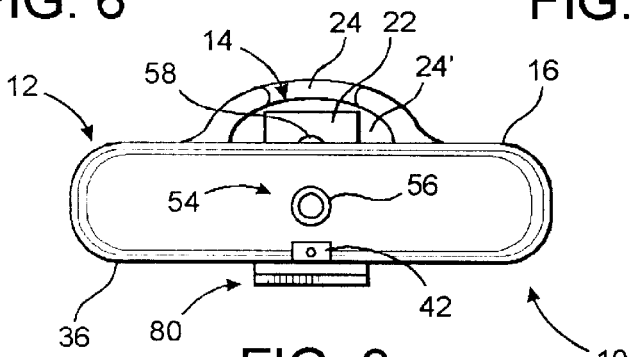
FIG. 8 is a bottom view of the embodiment of FIG. 1 of the present invention.

Yet another embodiment of the present invention is shown in FIGS. 1 and 8 and includes an illumination assembly generally indicated as 54. The illumination assembly 54 includes an electrically powered bulb 56 extending at least partially outward from the base 12 or otherwise positioned so as to direct illumination outwardly therefrom as generally indicated as 57. The illumination assembly 54 is normally in an "off" position in that it is not continuously activated. Activation thereof, which in turn causes the illumination 57 to issue or be projected from the base 12 is accomplished by the manual pressing or otherwise manipulation of a switch or button 58 preferably formed on an exposed surface 16 or other portion of the base 12 at a location which is readily accessible. As shown in FIGS. 1 and 8 the bulb 56 is mounted on what may generally considered a lower, exposed surface portion of the base 12 and the activating switch 58 is disposed in substantially adjacent relation thereto. It should be emphasized, however, that the bulb 56 and the activating switch 58 may be located at any applicable and convenient location on the base 12 which serves to efficiently direct the radiating illumination 57 outwardly from the base 12 in an intended fashion. Also the activating switch or button 58 may be disposed a spaced distance from the bulb 56 on an exposed surface of the base 12 which is clearly accessible and convenient to the user of the holder assembly 10 for purposes of energizing the illumination assembly 54. The illumination assembly 54 is generally utilized to also facilitate the services rendered by a bartender in either the preparation of various beverages, the serving of such beverages or as otherwise needed. In the embodiment of FIG. 8, base 12 may include an at least partially hollow configuration so as to enclose and support at least one dry cell battery therein to provide electric energy for the activation of the electrically powered bulb 56 as is conventionally known.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described.

What is claimed is:

1. A holder assembly designed to removably support and dispose one or sore utensils for convenient access and repeated use, said assembly comprising:

a) a base including a front surface and a rear surface, b) a pocket structure defined in said base and including a hollow interior having a predetermined dimension and configuration substantially corresponding to a first utensil to be contained therein, c) said pocket structure including a first opening disposed in communication with said hollow interior and dimensioned to allow passage of the first utensil therethrough and into and out of said hollow interior, d) a second opening formed in said pocket structure in communication with said hollow interior and extending upwardly along at least half a length thereof, e) said second opening disposed and dimensioned to facilitate digital contact with and displacement of the first utensil when disposed within said hollow interior, thereby substantially facilitating removal of said first utensil from said pocket structure; and f) a stop portion disposed within said hollow interior in engaging, at least partially supporting relation to the first utensil when disposed within said hollow interior; and g) a retraction structure mounted on said base and configured to retractable dispose a second utensil into an outwardly extended, operative orientation.

2. An assembly as recited in claim 1 further comprising an illumination assembly disposed in said base and structured to selectively generate light outwardly from said base.

3. An assembly as recited in claim 1 wherein said first utensil comprises a cigarette lighter and said second utensil comprises a bottle opener.

4. An assembly as recited in claim 1 further comprising two recesses formed in said front surface adjacent to and on opposite sides of said pocket structure, each of said two recesses being dimensioned to receive a finger of a user therein, thereby further facilitating said digital contact with and displacement of the first utensil by the finger disposed at said second opening.

5. An assembly as recited in claim 4 wherein said two recesses are each disposed in spaced, substantially adjacent relation to said second opening and being further configured to extend along said second opening.

6. An assembly as recited in claim 1 wherein said first opening is disposed at one end of said pocket structure, and said stop portion is disposed at an opposite end of said pocket structure and is cooperatively disposed and structured with said first opening to removably position the first utensil therebetween.

7. An assembly as recited in claim 6 wherein said second opening includes a substantially elongated configuration extending from said stop portion towards said first opening of said pocket structure.

8. An assembly as recited in claim 7 wherein said second opening is further configured to extend into and is at least partially defined in said stop portion so as to facilitate digital contact with an end of the first utensil and exert a lifting force thereon.

9. An assembly as recited in claim 7 wherein said second opening is disposed in spaced, segregated relation to said first opening and further includes a transitional zone integrally formed in said base about a periphery of said second opening.

10. An assembly as recited in claim 1 wherein said retraction structure includes an elongate, spring biased cord structured to retractably extend outwardly from said base, said cord including a free end at which the second utensil is disposed.

11. An assembly as recited in claim 10 wherein said base further comprises a compartment formed therein, said compartment including an interior portion and a retaining wall disposed in substantially surrounding relation to said interior portion and in containing relation to said spring bias cord.

12. An assembly as recited in claim 10 wherein said retraction structure further comprises a spring loaded casing into which said cord retracts, said spring loaded casing being operatively coupled with said base.

13. An assembly as recited in claim 12 wherein said base includes a passage form within said retaining wall and extending from said interior portion of said compartment to an exterior of said compartment; said passage dimensioned and disposed to allow passage of said cord therethrough to facilitate access to the second utensil exteriorly of said compartment.

14. An assembly as recited in claim 12 wherein said base further comprises a compartment formed therein and structured and disposed to receive said spring loaded casing operatively and securely therein.

15. An assembly as recited in claim 14 wherein said compartment is disposed at said rear surface of said base.

16. An assembly as recited in claim 15 wherein said pocket structure is disposed in said front surface of said base in substantially opposing relation to said compartment.

17. An assembly as recited in claim 14 wherein said compartment comprises an interior portion and a retaining wall disposed in substantially surrounding relation to said interior portion and in containing relation to said spring loaded casing positioned within said interior portion.

18. An assembly as recited in claim 17 wherein said base includes a passage defined in said retaining wall and extending from said interior portion of said compartment to an exterior of said compartment.

19. An assembly as recited in claim 18 wherein said passage is dimensioned and disposed to allow passage of said cord therethrough to facilitate access to the second utensil exteriorly of said compartment.

20. A holder assembly designed to support and dispose a plurality of utensils for convenient and repeated access and use, said assembly comprising:

a) a base including a front surface and a rear surface, b) a pocket structure formed in said front surface of said base and including a hollow interior;

c) a cigarette lighter structured to be removably contained in said hollow interior of said pocket structure;

d) said pocket structure including a first opening dimensioned to allow passage of the cigarette lighter therethrough and into and out of said hollow interior and a second opening extending at least one half way up along a length of said pocket structure and disposed and dimensioned to facilitate digital contact with and displacement of the cigarette lighter outwardly through said first opening, e) a compartment formed in said base;

f) a bottle opener; and g) a retraction structure disposed in said compartment of said base and structured to retractably secure said bottle opener to said base so as to permit said bottle opener to be extended into an operative orientation.

21. An assembly as recited in claim 20 further comprising a mounting assembly connected to said base for removably securing said base to a user's body, said mounting assembly disposed and structured to position said front surface in an outwardly directed, exposed position relative to the user's body.

22. An assembly as recited in claim 21 wherein said retraction assembly comprises a spring loaded casing disposed in said compartment and having a flexible biased cord associated therewith and coupled at a free end thereof to said bottle opener so as to achieve said retractable securing of said bottle opener to said base.

23. An assembly as recited in claim 22 wherein said pocket structure further includes a second opening defined therein and configured to extend into said pocket structure for digital engagement by a finger with the cigarette lighter contained in said pocket structure, thereby facilitating slided removal of said cigarette lighter from said pocket structure.

24. An assembly as recited in claim 23 further comprising two recesses formed in said front surface adjacent to and on opposite sides of said pocket structure, each of said two recesses being dimensioned to facilitate concurrent sliding engagement with separate fingers of a user therein.

25. An assembly as recited in claim 24 further comprising it an illumination assembly mounted on said base and disposed and structured to selectively generate light outward from said base.

26. A holder assembly designed to removably support and dispose one or more utensils for convenient access and repeated use, said assembly comprising:

a) a base including a front surface and a rear surface, b) a pocket structure defined in said base and including a hollow interior having a predetermined dimension and configuration substantially corresponding to a first utensil to be contained therein, c) said pocket structure including a first opening disposed in communication with said hollow interior and dimensioned to allow passage of the first utensil therethrough and into and out of said hollow interior, d) a second opening formed in said pocket structure in communication with said hollow interior and extending along a length thereof, e) said second opening disposed and dimensioned to facilitate digital contact with and displacement of the first utensil when disposed within said hollow interior, thereby substantially facilitating removal of said first utensil from said pocket structure, f) a stop portion disposed within said hollow interior in engaging, at least partially supporting relation to the first utensil when disposed within said hollow interior, and g) at least one recess formed in said front surface adjacent to said pocket structure and dimensioned and configured to receive a finger of a user at least partially therein.

27. An assembly as recited in claim 26 wherein said one recess is disposed in spaced, substantially adjacent relation to said second opening and being further configured to extend along at least a portion of the length of said hollow interior.

* * * * *